US011236486B2

(12) United States Patent
Vahling et al.

(10) Patent No.: US 11,236,486 B2
(45) Date of Patent: Feb. 1, 2022

(54) MULTIPIECE V-RAIL WEAR STRIP

(71) Applicant: Caterpillar Inc., Deerfield, IL (US)

(72) Inventors: Bruce Raymond Vahling, Urbana, IL (US); Nathaniel Keith Harshman, Sullivan, IL (US)

(73) Assignee: Caterpillar Inc., Peoria, IL (US)

( * ) Notice: Subject to any disclaimer, the term of this patent is extended or adjusted under 35 U.S.C. 154(b) by 295 days.

(21) Appl. No.: 16/459,963

(22) Filed: Jul. 2, 2019

(65) Prior Publication Data

US 2021/0002854 A1 Jan. 7, 2021

(51) Int. Cl.
*E02F 3/815* (2006.01)
*E02F 9/28* (2006.01)

(52) U.S. Cl.
CPC ..... *E02F 3/8157* (2013.01); *E02F 9/2883* (2013.01)

(58) Field of Classification Search
CPC ..... E02F 3/764; E02F 3/7659; E02F 3/8157; E02F 9/2883
See application file for complete search history.

(56) References Cited

U.S. PATENT DOCUMENTS 3,463,243 A * 8/1969 Fisher ..... E02F 3/8157 172/781
3,465,829 A 9/1969 Caterpillar
3,736,987 A * 6/1973 Easterling ..... E02F 3/841 172/4.5
3,983,945 A * 10/1976 Hart ..... E02F 3/80 172/795
4,037,670 A * 7/1977 Atherton ..... E02F 3/764 172/795
4,058,174 A * 11/1977 Atherton ..... E02F 3/3618 172/781
4,060,136 A * 11/1977 Hendrickson ..... E02F 3/765 172/795
4,074,767 A * 2/1978 Cole ..... E02F 3/8157 172/781
4,176,477 A * 12/1979 Farden ..... E02F 3/401 172/815
5,076,370 A * 12/1991 Stubben ..... E02F 3/80 172/781
5,687,800 A * 11/1997 Wilkening ..... E02F 3/8157 172/741
6,813,849 B2 * 11/2004 McGugan ..... E02F 3/815 172/811
7,650,949 B1 * 1/2010 Horstman ..... E02F 3/8152 172/795
7,676,964 B2 * 3/2010 Schmeichel ..... E01H 5/061 37/268
8,136,269 B1 * 3/2012 Sempf ..... E01H 5/068 37/266
8,875,419 B2 * 11/2014 Schmeichel ..... E01H 5/062 37/231
9,809,950 B2 * 11/2017 Zimmerman ..... E02F 3/7663
10,113,282 B2 * 10/2018 Behan ..... E01H 5/061
(Continued)

*Primary Examiner* — Jessica H Lutz

(57) ABSTRACT

A v-shaped wear strip includes a v-shaped body defining a longitudinal axis, a first end, and a second end disposed along the longitudinal axis. The v-shaped body includes a first attachment portion defining a first aperture, a first pressing portion that forms a first oblique angle with the first attachment portion at the first end, and a first arcuate portion transitioning from the first attachment portion to the first pressing portion at the first end.

19 Claims, 8 Drawing Sheets

(56) References Cited

U.S. PATENT DOCUMENTS

| | | | | |
|---|---|---|---|---|
| 2002/0170724 | A1* | 11/2002 | McGugan | E02F 3/8157 172/781 |
| 2003/0042029 | A1* | 3/2003 | Michael, Jr. | E02F 3/815 172/781 |
| 2006/0070758 | A1* | 4/2006 | Ryan | E02F 3/7654 172/781 |
| 2006/0130305 | A1* | 6/2006 | Englot | E02F 3/80 29/402.09 |
| 2008/0138154 | A1* | 6/2008 | Horstman | E02F 3/3604 404/101 |
| 2016/0215814 | A1* | 7/2016 | Cox | F16C 11/0628 |
| 2018/0106013 | A1* | 4/2018 | Cox | E02F 3/8157 |
| 2019/0177949 | A1* | 6/2019 | Harshman | E02F 3/815 |
| 2020/0024822 | A1* | 1/2020 | Costner, III | E02F 3/8157 |
| 2020/0263388 | A1* | 8/2020 | Vahling | E02F 3/8157 |
| 2020/0354922 | A1* | 11/2020 | Tissier | E02F 3/765 |

* cited by examiner

MULTIPIECE V-RAIL WEAR STRIP

TECHNICAL FIELD

The present disclosure relates to mounting assemblies for attaching scarifier boards or blades used by motor graders or other similar equipment to the machine. More specifically, the present disclosure relates to wear strips that facilitate the attachment of a board assembly or a blade assembly to the machine.

BACKGROUND

Machines such as motor graders employ a long blade that is used to level work surfaces during the grading phase of a construction project or the like. These blades often encounter abrasive material such as rocks, dirt, etc. that can degrade the working edge, making such blades ineffective for their intended purpose. Accordingly, it is desirable to mount or demount the blade to facilitate replacement of the blade or changing the type of blade attached to the machine when using the machine in different applications.

Various systems have been employed to attach the board or blade to the machine. In many cases, an upper jaw and a lower jaw are provided that clamp onto an upper portion and a lower portion of the blade or board assembly for holding it onto the machine. A wear strip may be provided that may be replaced to compensate for tolerance stack ups and the wear of the upper and lower portions of the blade assembly or board assembly as well as the mounting mechanism itself. Manufacturing the wear strip may be more difficult or more expensive than desired.

U.S. Pat. No. 5,076,370 to Stubben et al. discloses a mounting assembly for a grader moldboard. The assembly includes a mounting frame with first and second retainers having V-shaped notches that cooperate with a V-shaped engaging portion locating on the mounting rails of the moldboard. Each of the V-shaped notches are provided with first and second wear strips defining the wings of the V-shaped notch. The wear strips have a sliding surface in sliding contact with the mounting rails and a contact surface which contacts the adjoining wear strip in the V-shaped notch. Locating protuberances are located at each end of the wear strips to hold the wear strips in proper position. The ends of the wear strips are also provided with abutment surfaces which contact the base of the retainer clips.

As can be seen by looking at the figures of Stubben, the shape of its wear strips require expensive manufacturing such as casting, or machining, etc. Accordingly, there exists a need for a wear strip for use in a mounting assembly for attaching a blade assembly or a board assembly to the machine that is less complicated and more cost effective.

SUMMARY OF THE DISCLOSURE

A mounting assembly according to an embodiment of the present disclosure for attaching a board assembly or a blade assembly to a grading machine is provided. The mounting assembly may comprise a jaw member defining a Y-shaped slot defining a longitudinal axis, a horizontal direction, and a vertical direction, forming a first wear strip attachment portion that extends vertically, and a first angled wear strip support portion that forms a first obtuse angle with the first wear strip attachment portion, and a first v-shaped wear strip including a first attachment leg defining a first fastener receiving aperture extending horizontally through the first attachment leg, and a first pressing leg that is configured to press onto a board assembly or a blade assembly for holding the board assembly or the blade assembly to the grading machine. The first wear strip attachment portion of the jaw member may define a first mounting aperture that extends horizontally and that is aligned with the first fastener receiving aperture of the first v-shaped wear strip.

A v-shaped wear strip according to an embodiment of the present disclosure is provided. The v-shaped wear strip may comprise a v-shaped body defining a longitudinal axis, a first end, and a second end disposed along the longitudinal axis, the v-shaped body including a first attachment portion, a first pressing portion that forms a first oblique angle with the first attachment portion at the first end, and a first arcuate portion transitioning from the first attachment portion to the first pressing portion at the first end. The first oblique angle may range from 130 degrees to 140 degrees, and the v-shaped body may comprises a metallic material. The first attachment portion may define a minimum thickness measured along a direction perpendicular to the longitudinal axis at the first end ranging from 3 mm to 10 mm, the first arcuate portion may define a convex radius of curvature at the first end ranging from 13 mm to 20 mm, and the v-shaped body may define a longitudinal length measured along the longitudinal axis from the first end to the second end ranging from 150 mm to 500 mm.

A method according to an embodiment of the present disclosure for mounting or demounting a v-shaped wear strip to a jaw member of a mounting assembly for attaching a blade assembly or a board assembly to a machine is provided. The method may comprise inserting a first fastener into the first mounting aperture of the jaw member, and inserting the first fastener into the first fastener receiving aperture of a first v-shaped wear strip.

DETAILED DESCRIPTION

Figure 1:
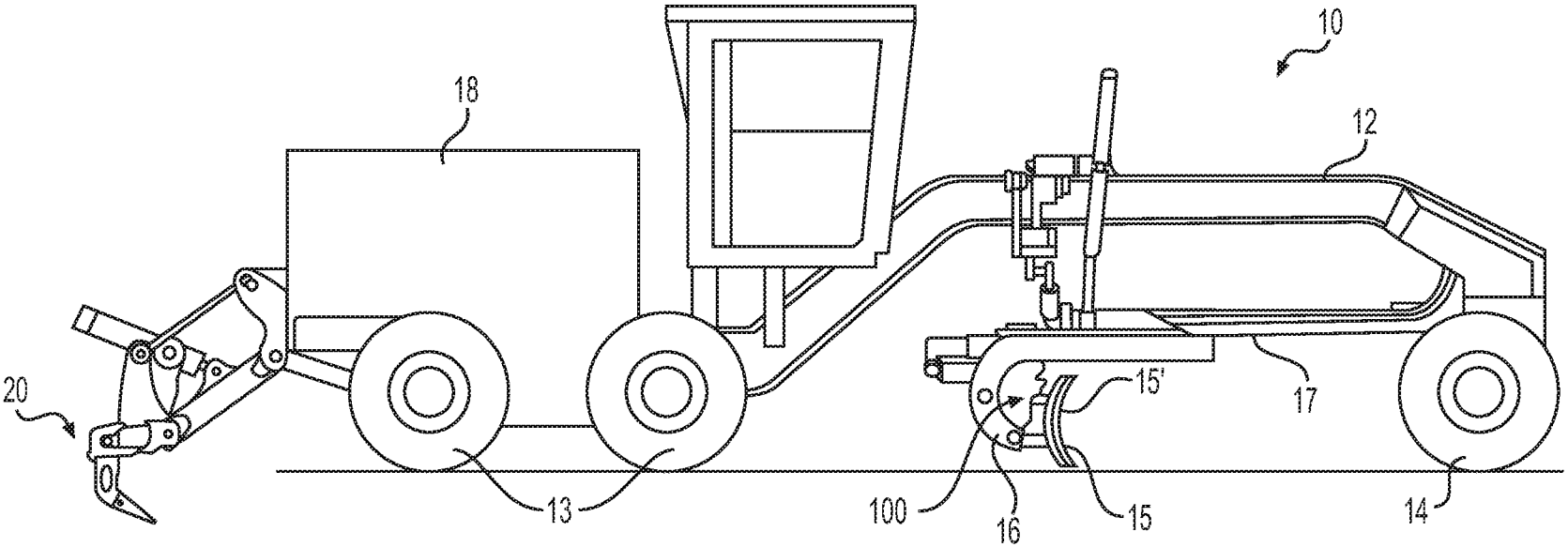
FIG. 1 is a side view of a motor grader that may employ a mounting assembly for attaching a blade assembly or a board assembly to the machine using a multi-piece v-rail wear strip according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

A mounting assembly that uses v-shaped wear strips for engaging a disengaging portions of a board assembly or blade assembly for holding a board assembly or a blade assembly according to an embodiment of the present disclosure will now be discussed. Also, the specific design of a v-shaped wear strip according to an embodiment of the present disclosure will be described. A method of replacing v-shaped wear strips according to another embodiment of the present disclosure will then be explained.

First, a machine will now be described to give the reader the proper context for understanding how various embodiments of the present disclosure are used. It is to be understood that this description is given as exemplary and not in any limiting sense. Any embodiment of an apparatus or method described herein may be used in conjunction with any suitable machine.

Referring to FIG. 1, a machine 10 such as a motor grader is depicted. The machine 10 has a frame 12 and a ground engaging propulsion system including two sets of rear wheels 13 and a set of front wheels 14. A blade assembly 15' or board assembly 15 is mounted on a blade tilt adjustment mechanism 16 that is supported by a rotatable circle assembly 17 positioned beneath frame 12. A variety of hydraulic cylinders may be provided for controlling the position of the board assembly 15 or blade assembly 15'. A prime mover such as engine 18 provides the power necessary to propel the machine 10 as well as operate the various actuators and systems of the machine. In a hydrostatically operated machine, the engine 18 powers a hydro static pump (not shown) which in turn drives a hydrostatic motor (not shown) to propel the machine 10. The hydro static pump may also drive other hydraulic systems of the machine. A ripper assembly 20 may be mounted at a rear section of the frame 12 of the machine 10. Although ripper assembly 20 is mounted on a motor grader, the ripper assembly may be mounted on other types of machines such as a dozer, a tractor and the like.

As alluded to previously, a mounting assembly 100 may be provided that allows the blade assembly 15' or board assembly 15 to be attached or detached from the machine. The mounting assembly may described as follows focusing on FIGS. 2 thru 4.

Figure 2:
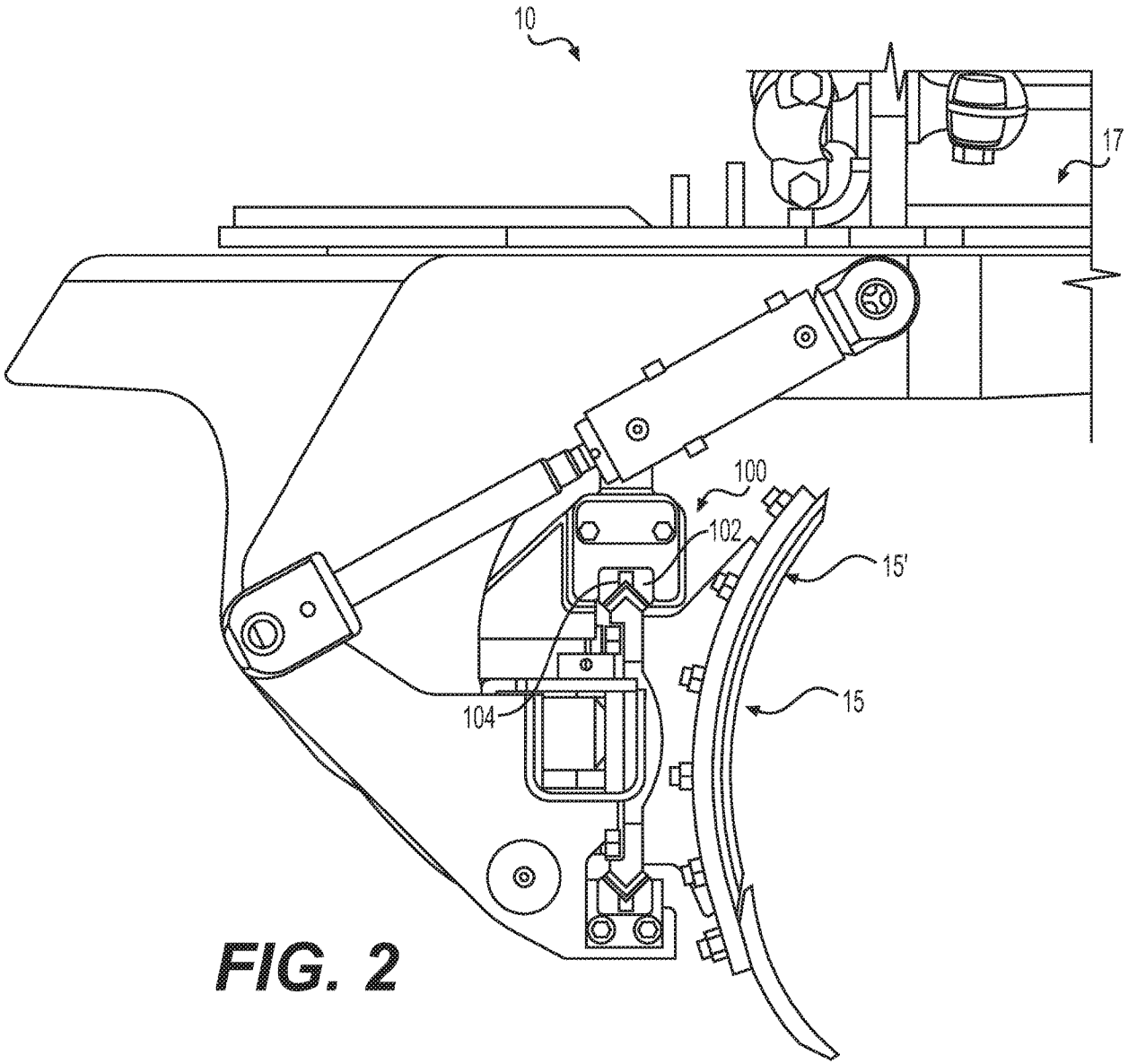
FIG. 2 is a side view of a mounting assembly for attaching a blade assembly or a board assembly to the machine of FIG. 1 using a multi-piece v-rail wear strip according to an embodiment of the present disclosure.

Starting with FIG. 2, a mounting assembly 100 for attaching a board assembly 15 or a blade assembly 15' to a grading machine 10 according to an embodiment of the present disclosure is provided. The mounting assembly 100 may comprise a jaw member 102 (may also be referred to as a mounting block) defining a Y-shaped slot 104, forming a first wear strip attachment portion 106 that extends vertically (i.e. substantially vertically such that this portion 106 forms an angle that is 45 degrees or less with the vertical direction), and a first angled wear strip support portion 108 that forms a first obtuse angle 110 (best seen in FIG. 3) with the first wear strip attachment portion 106. The jaw member that will be focused on herein is the upper jaw member but it is to be understood that the lower jaw member may be similarly or identically configured as the upper jaw member. So, similar or identically configured v-shaped wear inserts may be used on both the upper and lower jaws in some embodiments.

Figure 3:
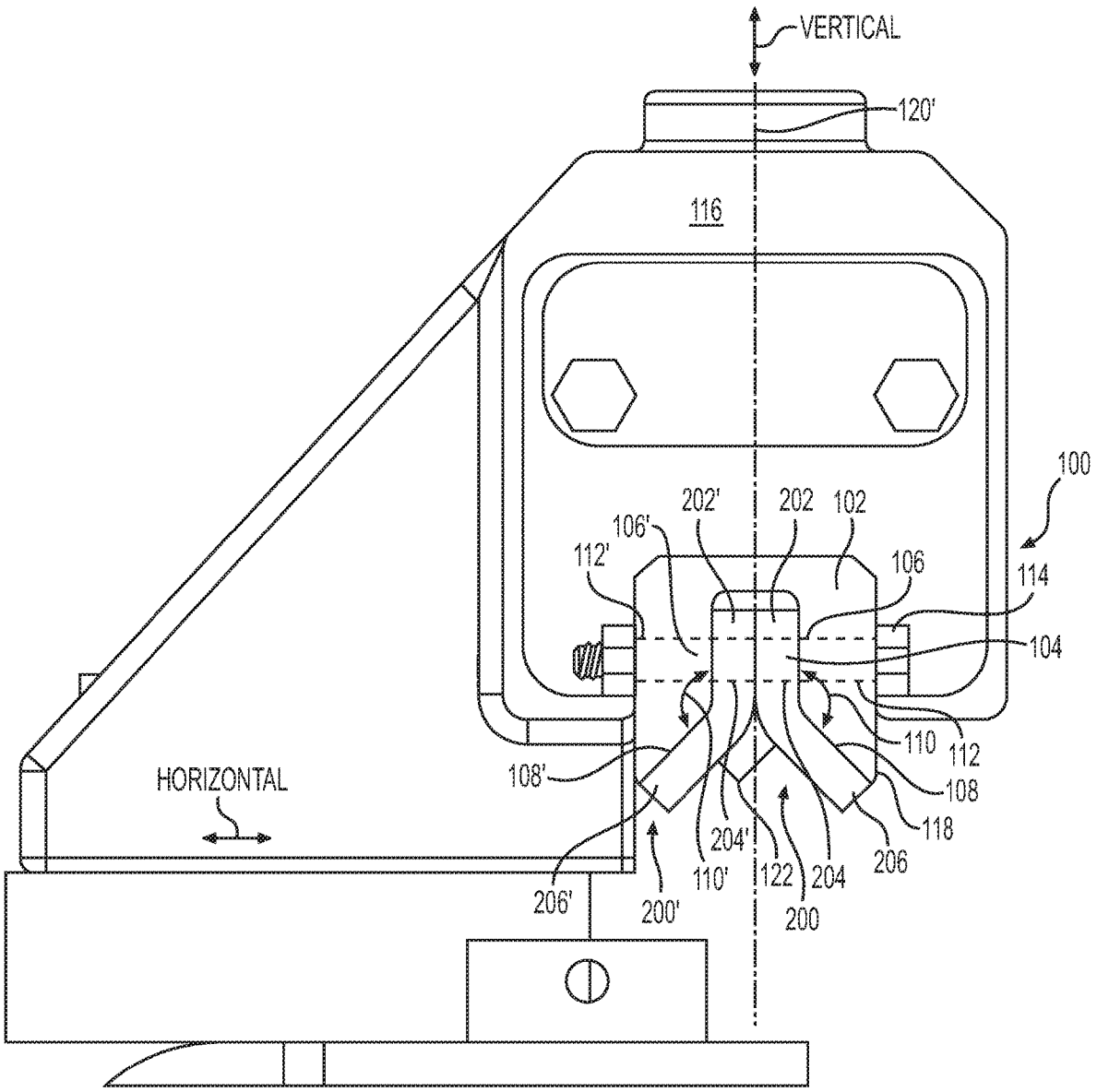
FIG. 3 is an enlarged detail view of the upper portion of the mounting assembly of FIG. 2 including the upper jaw of the mounting assembly with the blade assembly or board assembly removed for enhanced clarity.
Figure 4:
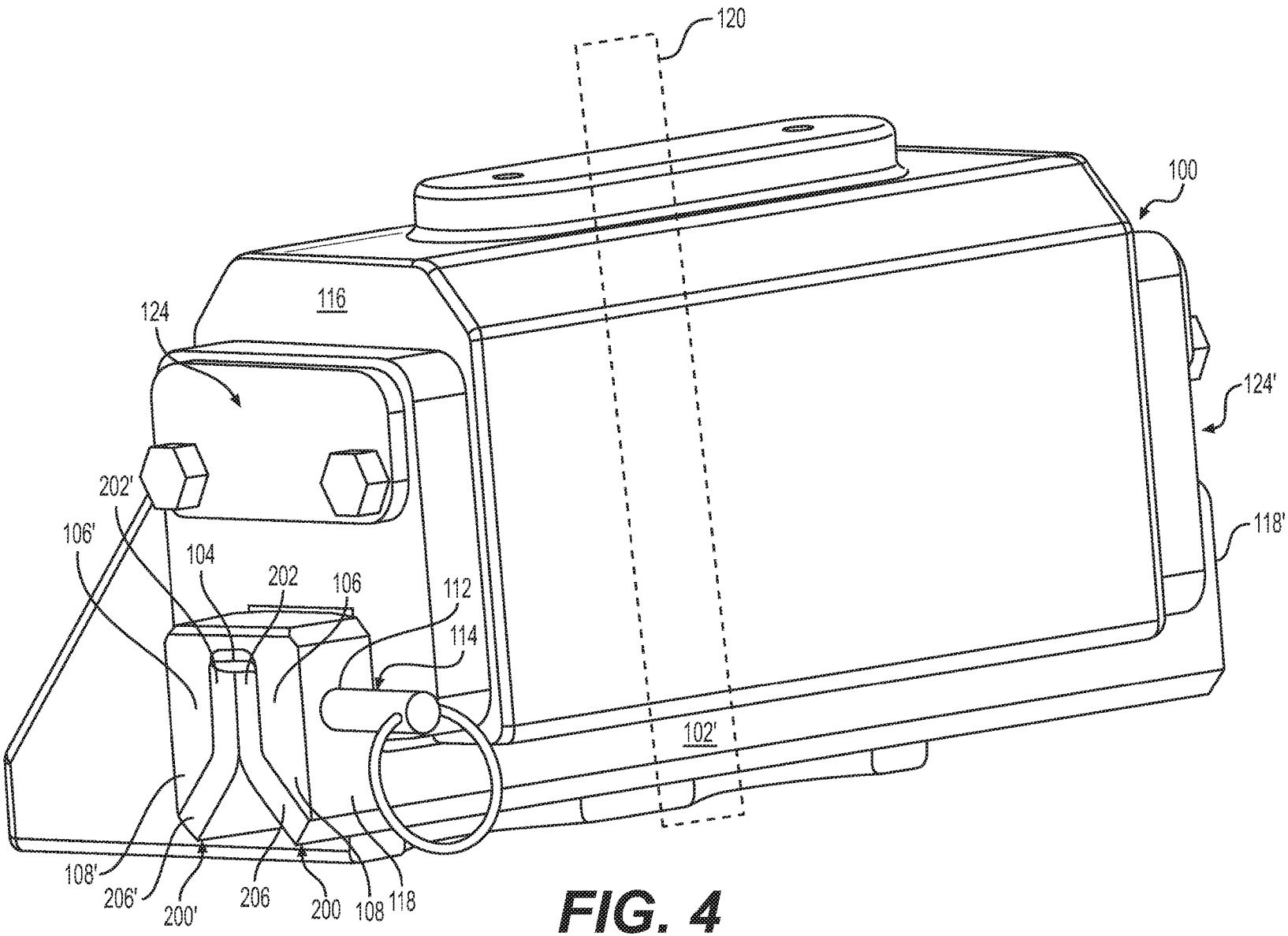
FIG. 4 is a perspective view of the upper portion including the upper jaw of the mounting assembly of FIG. 2 with the blade assembly or the board assembly removed for enhanced clarity.
Figure 5:
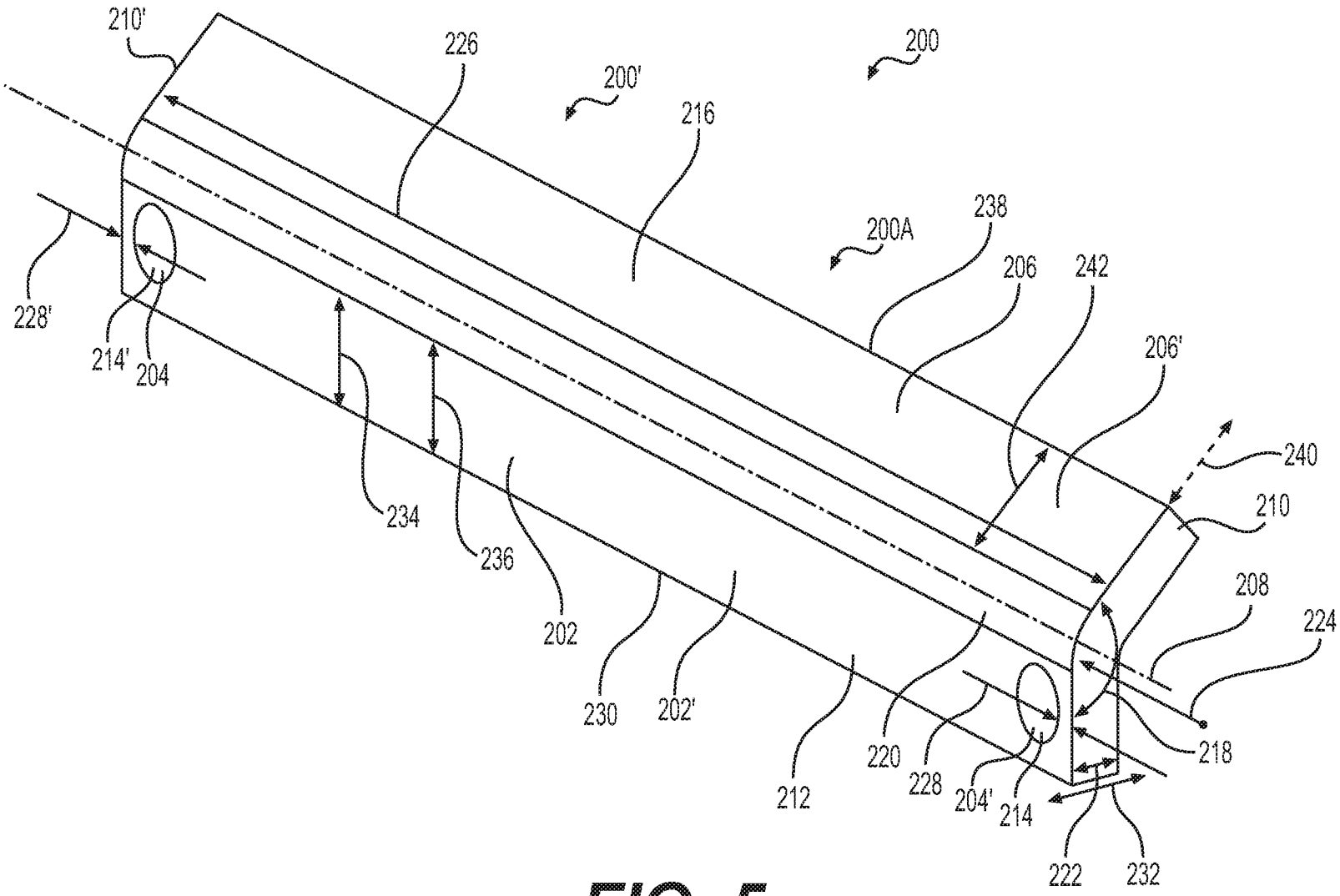
FIG. 5 is a perspective view of a v-shaped wear strip according to an embodiment of the present disclosure that is used in the mounting assembly of FIGS. 2 thru 4 shown in isolation.

Referring now to FIGS. 3 thru 5, a first v-shaped wear strip 200 may also be provided according to an embodiment of the present disclosure. The first v-shaped wear strip 200 may include a first attachment leg 202 that defines a first fastener receiving aperture 204 extending horizontally through the first attachment leg 202. The first v-shaped wear strip 200 may further include a first pressing leg 206 that is configured to press onto a board assembly 15 or a blade assembly 15' for holding the board assembly 15 or the blade assembly 15' to the grading machine 10. The first wear strip attachment portion 106 of the jaw member 102 may define a first mounting aperture 112 that extends horizontally (i.e. substantially horizontally such that this aperture 112 extends in a direction that forms an angle that is 45 degrees or less with the horizontal direction) and that is aligned with the first fastener receiving aperture 204 of the first v-shaped wear strip 200. Hence, a first fastener 114 (e.g. a bolt, a dowel pin, a cotter pin, a lanyard (detent) pin, a clevis pin, etc.) may be inserted into the both the first fastener receiving aperture 204 of the first v-shaped wear strip 200 and the first mounting aperture 112 of the jaw member 102 to hold the first v-shaped wear strip 200 to the jaw member 102.

Similarly, the jaw member 102 may further comprise a second wear strip attachment portion 106' that extends vertically and is diametrically opposite of the first wear strip attachment portion 106 (e.g. facing the first wear strip attachment portion). The second wear strip attachment portion 106' may define a second mounting aperture 112' that extends horizontally. Also, a second angled wear strip support portion 108' may be provided that forms a second obtuse angle 110' with the second wear strip attachment portion 106'.

The mounting assembly 100 may further comprise a second v-shaped wear strip 200' including a second attachment leg 202' defining a second fastener receiving aperture 204' extending horizontally through the second attachment leg 202' that is aligned with the second mounting aperture 112', and a second pressing leg 206' that is configured to press onto a board assembly 15 or a blade assembly 15' for holding the board assembly 15 or the blade assembly 15' to machine 10.

In some embodiments, the first mounting aperture 112, the first fastener receiving aperture 204, the second mounting aperture 112', and the second fastener receiving aperture 204' are aligned. Thus, the same first fastener 114 may be used to attach both the first v-shaped wear strip 200 and the second v-shaped wear strip 200' to the jaw member 102 in some embodiments. In other embodiments, two different fasteners may be used such as when apertures 204, 204" are threaded, etc.

The mounting assembly 100 may further comprise a head 116 to which the jaw member 102 is attached. The jaw member 102 may extend horizontally past the head 116 forming a first free end 118 of the jaw member 102. So, the first fastener receiving aperture 204, the first mounting aperture 112, the second fastener receiving aperture 204', and the second mounting aperture 112' are disposed horizontally at the first free end 118 of the jaw member 102, providing access to the first mounting aperture 112, the first fastener receiving aperture 204, the second mounting aperture 204', and the second fastener receiving aperture 204' in order to secure the first v-shaped wear strip 200 and the second v-shaped wear strip 200' to the jaw member 102.

As best seen in FIG. 4, the head 116 defines a first vertical plane of symmetry 120 for the head 116 and for the jaw member 102, forming a second free end 118' similarly or identically configured as the first free end 118.

As best seen in FIG. 3, the jaw member 102 may define a second vertical plane of symmetry 120' that is perpendicular to the first vertical plane of symmetry 120 such that the first v-shaped wear strip 200 and the second v-shaped wear strip 200' are mirror images of each other, or nearly so. In some embodiments, these wear strips are identically constructed, but not necessarily so. The first obtuse angle 110 and the second obtuse angle 110' of the jaw member 102 have the same value (e.g. approximately 135 degrees), and the first pressing leg 206 and the second pressing leg 206' form a first right angle 122.

Looking now at FIG. 5, a first v-shaped wear strip 200 according to an embodiment of the present disclosure may be characterize as follows. The first v-shaped wear strip 200 may comprise a v-shaped body 200*a* defining a longitudinal axis 208 (e.g. the direction of greatest extent for the body 200*a*), a first end 210, and a second end 210' disposed along the longitudinal axis 208. The v-shaped body 200*a* may include a first attachment portion 212 defining a first hole 214 disposed proximate the first end 210, and a second hole 214' disposed proximate the second end 210'. The v-shaped body 200*a* may also include a first pressing portion 216 that forms a first oblique angle 218 with the first attachment portion 212 at the first end 210, and a first arcuate portion 220 transitioning from the first attachment portion 212 to the first pressing portion 216 at the first end 210.

The first oblique angle 218 may range from 130 degrees to 140 degrees (e.g. 135 degrees) in some embodiments. Also, the first attachment portion 212 may define a minimum thickness 222 measured along a direction 232 perpendicular to the longitudinal axis 208 at the first end 210 ranging from 3 mm to 10 mm, and the first arcuate portion 220 may define a convex radius of curvature 224 at the first end 210 ranging from 13 mm to 20 mm in some embodiments.

Furthermore, the v-shaped body 200*a* may define a longitudinal length 226 measured along the longitudinal axis from the first end 210 to the second end 210' ranging from 150 mm to 500 mm, a first minimum distance 228 measured from the first end 210 to the first hole 214 along the longitudinal axis 208 ranging from 1 mm to 10 mm (e.g. 5 mm), and a second minimum distance 228' measured from the second end 210' to the second hole 214' along the longitudinal axis 208 ranging from 1 mm to 10 mm (e.g. 5 mm) in some embodiments. These distances may help reduce the likelihood that a tear or crack develops from a hole to an end of the v-shaped body.

Also, the first attachment portion 212 may define a first free end 230 (may be a top free end when oriented for assembly) that is disposed along a first direction 234 that is perpendicular to the longitudinal axis 208 and to the direction 232 along which the minimum thickness 222 is measured, and a first width 236 measured at the first end 210 from the first free end 230 to the first arcuate portion 220 along the first direction 234 ranging from 30 mm to 100 mm in some embodiments.

Likewise, the first pressing portion 216 may define a second free end 238 (may be a bottom free end when oriented for assembly) disposed along a second direction 240 that forms the first oblique angle 218 relative to the first direction 234, and a second width 242 measured at the first end 210 from the first arcuate portion 220 to the second free end 238 along the second direction 240 in some embodiments. The second width 242 may range from 14 mm to 50 mm in certain embodiments.

Figure 6:
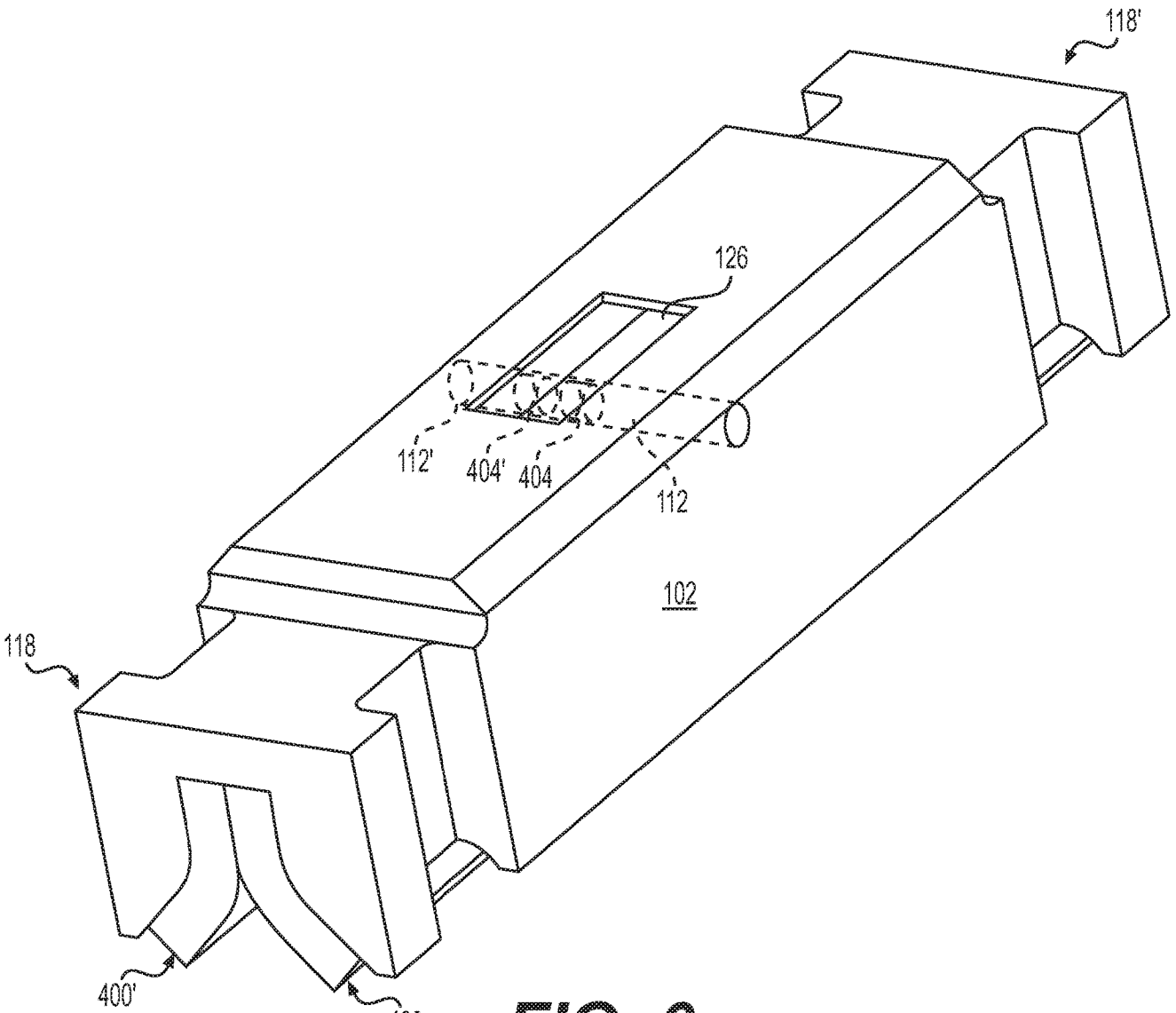
FIG. 6 is a perspective view of an alternate embodiment of a jaw member and v-shaped wear strips according to an embodiment of the present disclosure.
Figure 7:
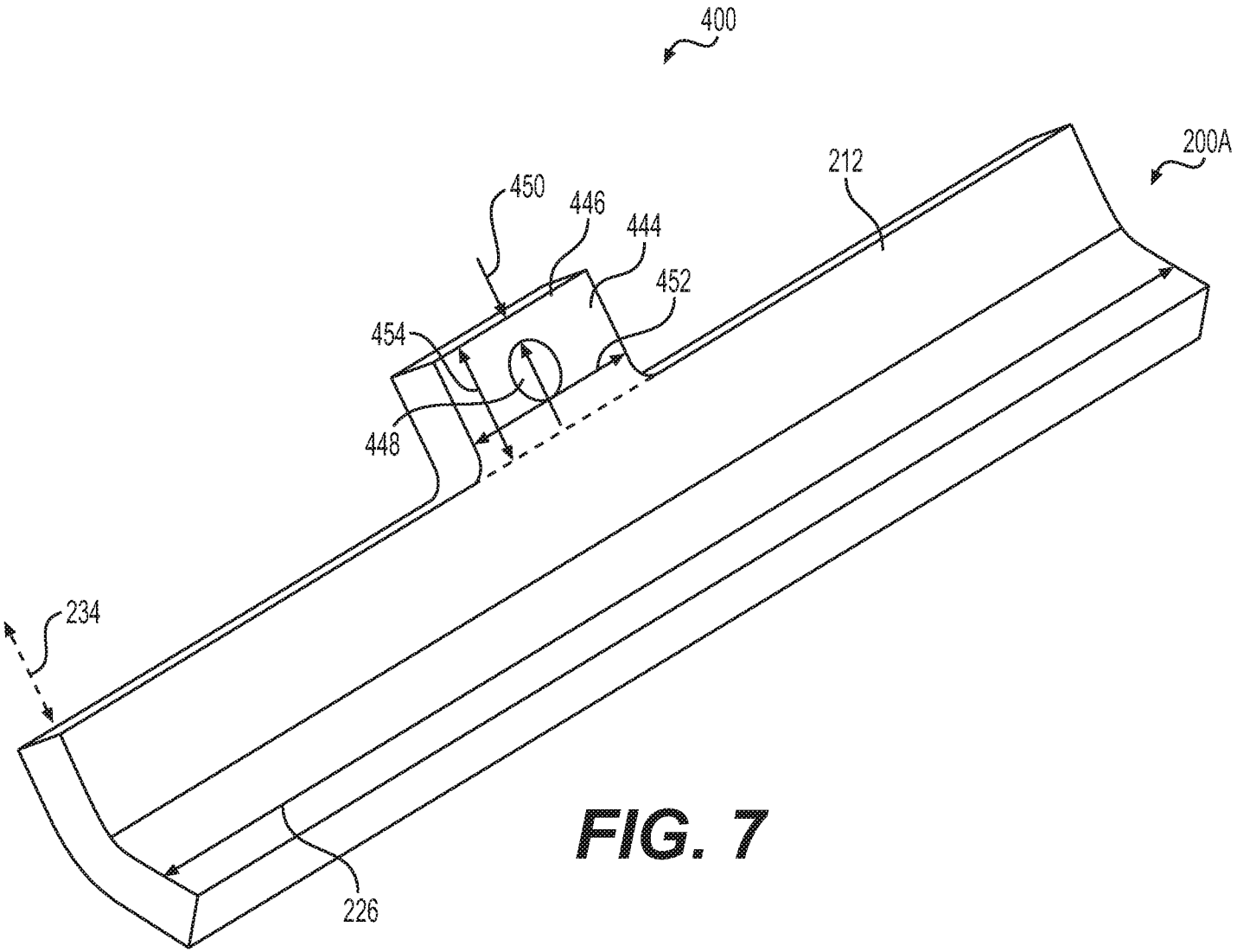
FIG. 7 is a perspective view of a v-shaped wear strip of FIG. 6 shown in isolation.

Referring now to FIGS. 6 and 7, an alternate embodiment of the present disclosure to that shown in FIGS. 3 thru 5 will now be discussed.

Focusing on FIG. 4, the head 116 may include a first yoke member 124 and a second yoke member 124' configured to receive the jaw member 102 for attaching the jaw member 102 to the head 116.

Looking at FIGS. 4 and 6 together, the head 116 defines a first vertical plane of symmetry 120 for the head 116 and for the jaw member 102, forming a second free end 118' of the jaw member 102 that is identically configured as the first free end 118 of the jaw member 102 and that is configured to be received by the second yoke member 124'.

As discussed previously referring to FIG. 3, the jaw member 102 defines a second vertical plane of symmetry 120' that is perpendicular to the first vertical plane of symmetry 120. So, as shown in FIG. 6, the first v-shaped wear strip 400 and the second v-shaped wear strip 400' are mirror images of each. The first v-shaped wear strip 400 and the second v-shaped wear strip 400' may be identically constructed but not necessarily so.

In addition, it is to be understood that both the embodiments in FIGS. 3 thru 5 and in FIGS. 6 and 7 are similarly or identically configured except for the following differences.

In FIG. 6, the first fastener receiving aperture 404, first mounting aperture 112, the second fastener receiving aperture 404', and the second mounting aperture 112' are disposed longitudinally at the middle of the jaw member 102. Also, a push out slot 126 that extends vertically through the top of the jaw member 102 that is in communication with the Y-shaped slot 104 for allowing the wear strips 400, 400' to be pushed out of the jaw member 102 after the jaw member 102 has been removed from the head 116. A fastener such as a dowel pin may be used in this embodiment to retain the v-shaped wear strips in place by inserting the dowel in the apertures of the v-shaped wear strip.

In FIG. 7, the first v-shaped wear strip 400 includes an attachment tab 444 extending from the first attachment portion 212 midway along the longitudinal length 226 of the v-shaped body 200*a*. The attachment tab 444 may define a free edge 446 and a single thru-hole 448 spaced a minimum dimension 450 away from the free edge 446 ranging from 9 mm to 20 mm. The attachment tab 444 may also define a longitudinal width 452 ranging from 35 mm to 150 mm, and a transverse height 454 measured along the first direction 234 ranging from 20 mm to 50 mm.

In some embodiments, the v-shaped wear strip comprises a brass, bronze, non-metallic (e.g. plastic), steel, iron material. With the aforementioned dimensions, the v-shaped wear strip is suited to be formed using a press brake bending operation, a stamping die operation, etc. Hence, the v-shaped wear strip may be easily and cost effectively manufactured in some embodiments of the present disclosure.

Any of the aforementioned dimensions, configurations, and materials may be altered to be different in other embodiments of the present disclosure.

INDUSTRIAL APPLICABILITY

In practice, a mounting assembly and/or a v-shaped wear strip may be manufactured, bought, assembled, or sold to retrofit an existing machine or mounting assembly in the field or be supplied as a replacement. In other situations, the mounting assembly and/or the v-shaped wear strip may be supplied or obtained when a machine or a mounting assembly is originally bought from the OEM (original equipment manufacturer), etc.

In either case, the following method 300 may be used to replace or mount a v-shaped wear strip to a mounting assembly.

Figure 8:
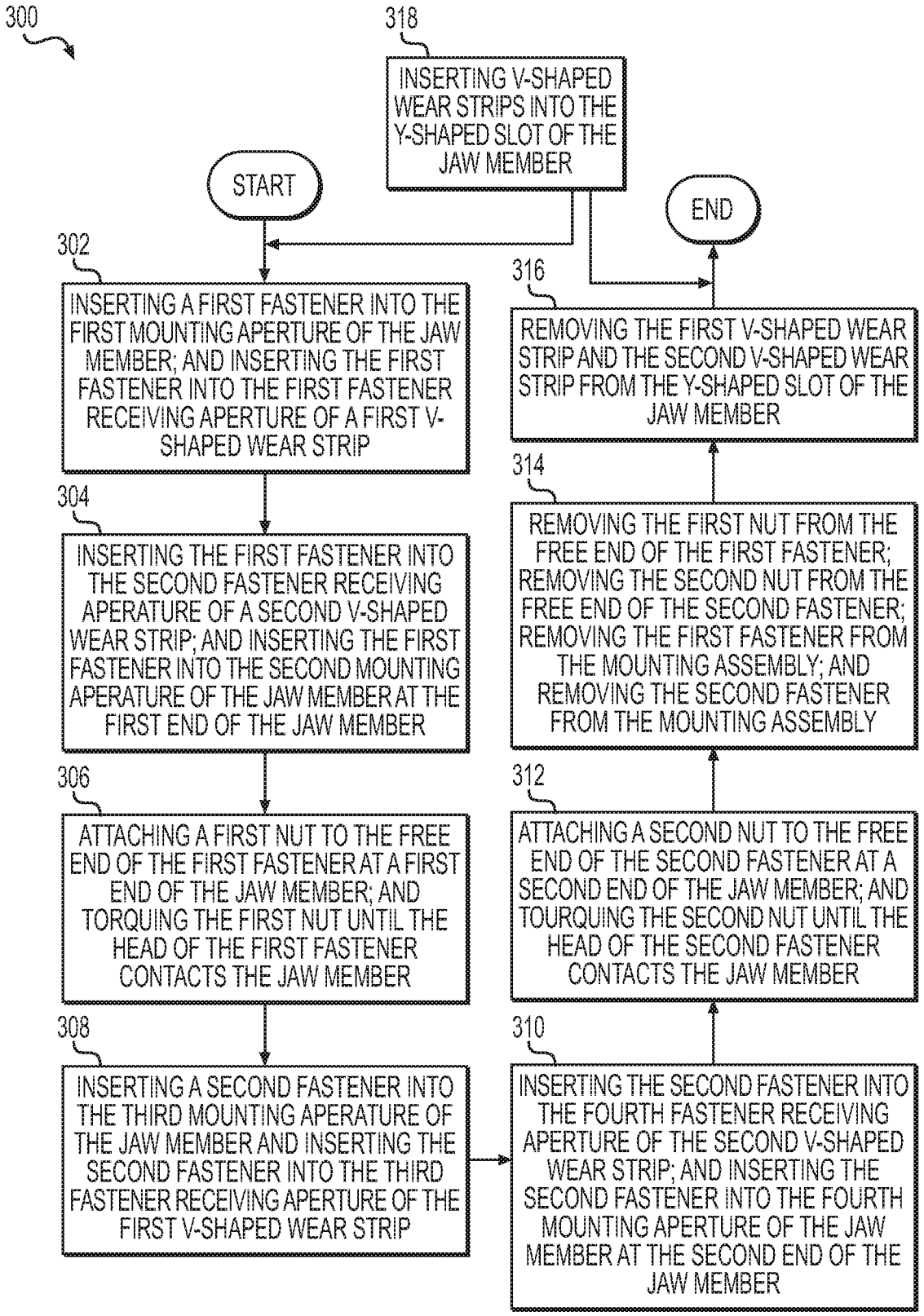
FIG. 8 is a flowchart depicting the steps of a method for replacing a v-shaped wear strip in a mounting assembly according to an embodiment of the present disclosure.

FIG. 8 illustrates the steps of this method. The method 300 may comprising:

inserting a first fastener into the first mounting aperture of the jaw member disposed at a first end of the jaw member; and inserting the first fastener into the first fastener receiving aperture of a first v-shaped wear strip (step 302).

The method 300 may further comprise:

inserting the first fastener into the second fastener receiving aperture of a second v-shaped wear strip; and inserting the first fastener into the second mounting aperture of the jaw member at the first end of the jaw member (step 304). This step may be omitted in other embodiments of the present disclosure.

The method 300 may further comprise attaching a first nut to the free end of the first fastener disposed at a first end of the jaw member; and torqueing the first nut until the head of the first fastener contacts the jaw member (step 306). This step may be omitted in other embodiments of the present disclosure.

Using the principle of symmetry as alluded to earlier herein, the method 300 may further comprising:

inserting a second fastener into the third mounting aperture of the jaw member; and inserting the second fastener into the third fastener receiving aperture of the first v-shaped wear strip (step 308).

Also, the method 300 may further comprise:

inserting the second fastener into the fourth fastener receiving aperture of the second v-shaped wear strip; and inserting the second fastener into the fourth mounting aperture of the jaw member at the second end of the jaw member (step 310). This step may be omitted in other embodiments of the present disclosure.

The method 300 may further comprise attaching a second nut to the free end of the second fastener disposed at the second end of the jaw member; and torqueing the second nut until the head of the second fastener contacts the jaw member (step 312). This step may be omitted in other embodiments of the present disclosure.

Now, the wear strips are assembled or installed. It may be desirable to install new or replacement wear strips.

Thus, the method 300 may further comprise:

removing the first nut from the free end of the first fastener;

removing the second nut from the free end of the second fastener;

removing the first fastener from the mounting assembly; and removing the second fastener from the mounting assembly (step 314).

Next, the method may further comprise removing the first v-shaped wear strip and the second v-shaped wear strip from the Y-shaped slot of the jaw member (step 316).

To start the reassembly process or the initial assembly process, the method 300 may further comprising inserting v-shaped wear strips into the Y-shaped slot of the jaw member (step 318).

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A mounting assembly for attaching a board assembly or a blade assembly to a grading machine, the mounting assembly comprising:

a jaw member defining a Y-shaped slot defining a vertical direction, a horizontal direction, and a longitudinal axis, the jaw member forming a first wear strip attachment portion that extends vertically, and a first angled wear strip support portion that forms a first obtuse angle with the first wear strip attachment portion; and a first v-shaped wear strip including a first attachment leg defining a first fastener receiving aperture extending horizontally through the first attachment leg, and a first pressing leg that is configured to press onto a board assembly or a blade assembly for holding the board assembly or the blade assembly to the grading machine;

wherein the first wear strip attachment portion of the jaw member defines a first mounting aperture that extends horizontally and that is aligned with the first fastener receiving aperture of the first v-shaped wear strip.

2. The mounting assembly of claim 1 wherein the jaw member further comprises a second wear strip attachment portion that extends vertically and is diametrically opposite of the first wear strip attachment portion, the second wear strip attachment portion defining a second mounting aperture that extends horizontally, and a second angled wear strip support portion that forms a second obtuse angle with the second wear strip attachment portion.

3. The mounting assembly of claim 2 further comprising a second v-shaped wear strip including a second attachment leg defining a second fastener receiving aperture extending horizontally through the second attachment leg that is aligned with the second mounting aperture, and a second pressing leg that is configured to press onto a board assembly or a blade assembly for holding the board assembly or the blade assembly to machine.

4. The mounting assembly of claim 3 wherein the first mounting aperture, the first fastener receiving aperture, the second mounting aperture, and the second fastener receiving aperture are aligned.

5. The mounting assembly of claim 4 further comprises a head to which the jaw member is attached, and wherein the jaw member extends horizontally past the head forming a first free end of the jaw member, and the first fastener receiving aperture, the first mounting aperture, the second fastener receiving aperture, and the second mounting aperture are disposed horizontally at the first free end of the jaw member, providing access to the first mounting aperture, the first fastener receiving aperture, the second mounting aperture, and the second fastener receiving aperture; and the head defines a first vertical plane of symmetry for the head and for the jaw member, forming a second free end, and the jaw member defines a second vertical plane of symmetry that is perpendicular to the first vertical plane of symmetry such that the first v-shaped wear strip and the second v-shaped wear strip are mirror images of each other.

6. The mounting assembly of claim 4 further comprising a head including a first yoke member and a second yoke member configured to receive the jaw member for attaching the jaw member to the head, and wherein the jaw member extends horizontally past the head forming a first free end of the jaw member that includes a t-shaped member that is configured to be received by the first yoke member, and the first fastener receiving aperture, the first mounting aperture, the second fastener receiving aperture, and the second mounting aperture are disposed longitudinally at the middle of the jaw member;

the head defines a first vertical plane of symmetry for the head and for the jaw member, forming a second free end of the jaw member that is identically configured as the first free end of the jaw member and that is configured to be received by the second yoke member, and the jaw member defines a second vertical plane of symmetry that is perpendicular to the first vertical plane of symmetry such that the first v-shaped wear strip and the second v-shaped wear strip are mirror images of each other;

and the head further defines a push out slot that extends vertically through the jaw member that is in communication with the Y-shaped slot.

7. The mounting assembly of claim 3 wherein first obtuse angle and the second obtuse angle of the jaw member have the same value, and the first pressing leg and the second pressing leg form a first right angle.

8. A v-shaped wear strip for use with a mounting assembly of a grading machine, the v-shaped wear strip comprising:

a v-shaped body defining a longitudinal axis, a first end, and a second end disposed along the longitudinal axis, the v-shaped body including a first attachment portion;

a first pressing portion that forms a first oblique angle with the first attachment portion at the first end; and a first arcuate portion transitioning from the first attachment portion to the first pressing portion at the first end; and wherein the first oblique angle ranges from 130 degrees to 140 degrees, the v-shaped body comprises a metallic material, the first attachment portion defines a minimum thickness measured along a direction perpendicular to the longitudinal axis at the first end ranging from 3 mm to 10 mm, the first arcuate portion defines a convex radius of curvature at the first end ranging from 13 mm to 20 mm, and the v-shaped body defines a longitudinal length measured along the longitudinal axis from the first end to the second end ranging from 150 mm to 500 mm.

9. The v-shaped wear strip of claim 8 wherein the first attachment portion defines a first free end disposed along a first direction that is perpendicular to the longitudinal axis and to the direction along which the minimum thickness is measured, and a first width measured at the first end from the first free end to the first arcuate portion along the first direction ranging from 30 mm to 100 mm, and the first pressing portion defines a second free end disposed along a second direction that forms the first oblique angle relative to the first direction, and a second width measured at the first end from the first arcuate portion to the second free end along the second direction, the second width ranging from 14 mm to 50 mm.

10. The v-shaped wear strip of claim 9 wherein the first attachment portion defines a first hole disposed proximate the first end, a second hole disposed proximate the second end, a first minimum distance measured from the first end to the first hole along the longitudinal axis ranging from 1 mm to 10 mm, and a second minimum distance measured from the second end to the second hole along the longitudinal axis ranging from 1 mm to 10 mm.

11. The v-shaped wear strip of claim 9 further comprising an attachment tab extending from the first attachment portion midway along the longitudinal length of the v-shaped body, the attachment tab defining a free edge and a single thru-hole spaced a minimum dimension away from the free edge ranging from 9 mm to 20 mm, and the attachment tab also defining a longitudinal width ranging from 35 mm to 150 mm, and a transverse height measured along the first direction ranging from 20 mm to 50 mm.

12. A method for mounting or demounting a plurality of v-shaped wear strips to a jaw member of a mounting assembly for attaching a blade assembly or a board assembly to a machine, the method comprising:

inserting a first fastener into a first mounting aperture of the jaw member;

inserting the first fastener into a first fastener receiving aperture of a first said v-shaped wear strip;

inserting the first fastener into a second fastener receiving aperture of a second said v-shaped wear strip; and inserting the first fastener into a second mounting aperture of the jaw member at a first end of the jaw member.

13. The method of claim 12 further comprising;

attaching a first nut to a free end of the first fastener at the first end of the jaw member; and torqueing the first nut until a head of the first fastener contacts the jaw member.

14. The method of claim 13 further comprising:

inserting a second fastener into a third mounting aperture of the jaw member; and inserting the second fastener into a third fastener receiving aperture of the first said v-shaped wear strip.

15. The method of claim 14 further comprising:

inserting the second fastener into a fourth fastener receiving aperture of the second said v-shaped wear strip; and inserting the second fastener into a fourth mounting aperture of the jaw member at a second end of the jaw member.

16. The method of claim 15 further comprising;

attaching a second nut to a free end of the second fastener at the second end of the jaw member; and torqueing the second nut until a head of the second fastener contacts the jaw member.

17. The method of claim 16 further comprising:

removing the first nut from the free end of the first fastener;

removing the second nut from the free end of the second fastener;

removing the first fastener from the mounting assembly; and removing the second fastener from the mounting assembly.

18. The method of claim 17 further comprising removing the first said v-shaped wear strip and the second said v-shaped wear strip from a Y-shaped slot of the jaw member.

19. The method of claim 18 further comprising inserting two new said v-shaped wear strips into the Y-shaped slot of the jaw member.

* * * * *